United States Patent [19]

Miller

[11] 4,082,127

[45] Apr. 4, 1978

[54] KNIFE HOLDER IN LOG SLABBING CHIPPER

[76] Inventor: Frederick L. B. Miller, 17353 SW. Canal Cir., Lake Oswego, Oreg. 97034

[21] Appl. No.: 790,008

[22] Filed: Apr. 22, 1977

[51] Int. Cl.[2] ..... B27G 13/04

[52] U.S. Cl. ..... 144/220; 83/698; 144/162 R; 407/49

[58] Field of Search ..... 144/162 R, 172, 176, 144/218, 220, 230, 225, 235; 29/105 R, 105 A; 83/698

[56] References Cited

U.S. PATENT DOCUMENTS

| | | | |
|---|---|---|---|
| 3,282,312 | 11/1966 | Standal | 144/220 |
| 3,570,567 | 3/1971 | Hickman | 144/220 |
| 3,777,793 | 12/1973 | Miller | 144/220 |
| 3,865,164 | 2/1975 | Sybertz | 144/218 X |
| 3,957,094 | 5/1976 | Maier | 144/218 X |

*Primary Examiner*—Donald R. Schran
*Assistant Examiner*—W. D. Bray
*Attorney, Agent, or Firm*—Lee R. Schermerhorn

[57] ABSTRACT

A chipper comprises a rotor with a plurality of knives adapted to slab off the side of a log so that the first saw cut following the chipper removes a usable board. In order to make usable pulp chips, the chipper knives are of bent configuration each having a grain cutting portion which cuts across the grain and a planing portion which cuts parallel with the grain to leave a smooth board surface on the log as it is moved lengthwise past the chipper on a saw carriage. Each knife is clamped rigidly in working position by a cambered clamp plate which is pivoted into clamped position in a manner causing it to flatten against substantially the whole area of the knife. A backing bar and wedge assembly provides fine adjustment for the knife.

9 Claims, 12 Drawing Figures

FIG. 3
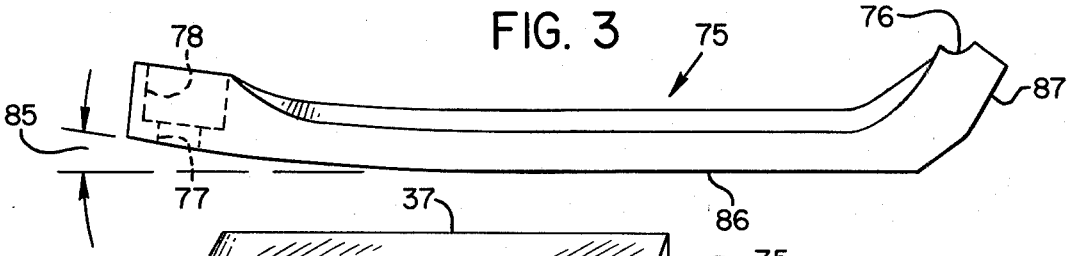
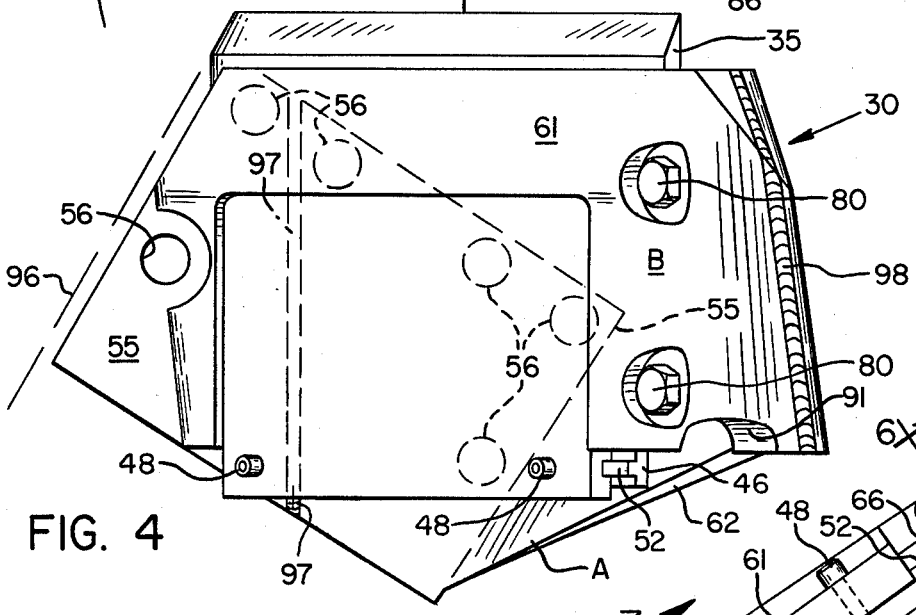
FIG. 4
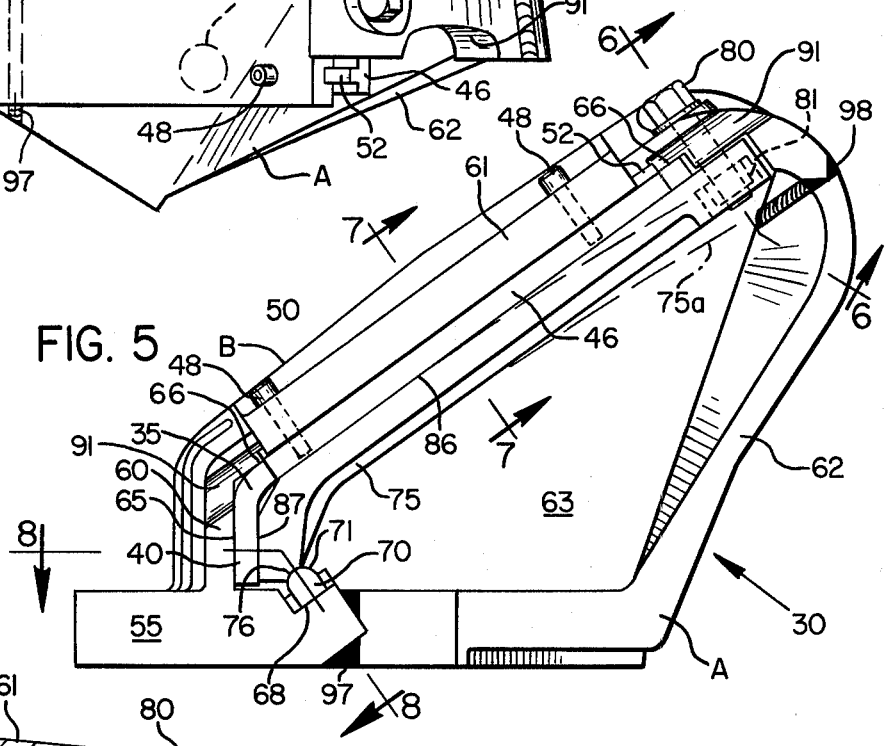
FIG. 5
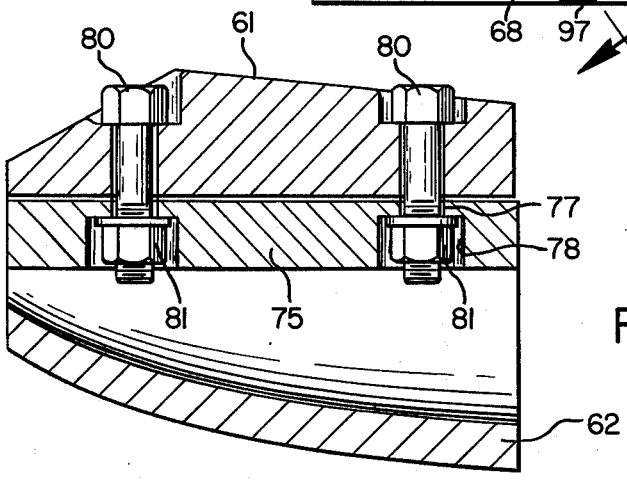
FIG. 6

KNIFE HOLDER IN LOG SLABBING CHIPPER

BACKGROUND OF THE INVENTION

This invention relates to a knife holder for a log slabbing chipper and other wood cutting machines such as lumber edging chippers.

In conventional practice, chipper knives are secured in a rotor head by clamp plates secured by screws perpendicular to the knife blade. This mounting arrangement requires deep slots in the knives to receive the clamp screws since the position of the knife varies in relation to the clamp screws as the knife becomes narrower from repeated sharpening. The slots complicate the manufacture of the knives, reduce the strength of the knives, introduce undesirable stresses in heat treating and reduce the service life of the knives by limiting the number of times they may be re-sharpened.

Also, the conventional knife clamping arrangements require a high degree of dimensional accuracy for positive positioning of the interfitting parts and provide inadequate support for the knife, resulting in frequent breakage. These deficiencies also often result in damage to the knife holder as well as the knife, thereby further increasing the maintenance cost of the machine.

My U.S. Pat. No. 3,777,793 discloses an improved knife and knife holder which overcome the foregoing disadvantages. The present invention relates to further improvements having additional features and advantages as set forth below.

Objects of the present invention are, therefore, to provide an improved knife holder in a log slabbing chipper or other wood cutting machine, to provide a knife holder which provides better support for the knife, to provide a knife holder which reduces breakage of both knives and holders, to provide a knife holder which will increase the service life of the knife to provide a knife holder adapted to receive unslotted knives, to provide a knife holder of more simple construction which requires less precision in its manufacture, is easier to maintain and adjust, requires less time for knife changing and offers less resistance to material flowing through the knife holder, and which has clamp screws accessible to impact or power wrenches.

SUMMARY OF THE INVENTION

In said U.S. Pat. No. 3,777,793 a crowned and tapered clamp plate is flattened against a face of the knife as the clamp plate is pulled on two wedges extending along opposite side edges of the knife. In the present construction the clamp pivots on a wedge on one edge while the camber is removed by screws at the other edge. A novel backing bar and wedge assembly provides a very simple form of fine adjustment for the knife. This far greater simplicity of construction and adjustment produces the important advantages referred to above.

The invention will be better understood and additional objects and advantages will become apparent from the following description of the preferred embodiments illustrated in the accompanying drawings. Various changes may be made, however, in details of construction and arrangement of parts and certain features may be used without others. All such modifications within the scope of the appended claims are included in the invention.

BRIEF DESCRIPTION OF THE DRAWINGS

FIG. 3 is a back end view of the knife clamp plate showing the crown, or camber.

FIG. 4 is a view showing the present knife holder as it appears when mounted on a chipper rotor head.

FIG. 5 is an elevation view of the knife holder.

FIG. 6 is a view on the line 6—6 in FIG. 5.

DESCRIPTION OF THE PREFERRED EMBODIMENTS

Figure 1:
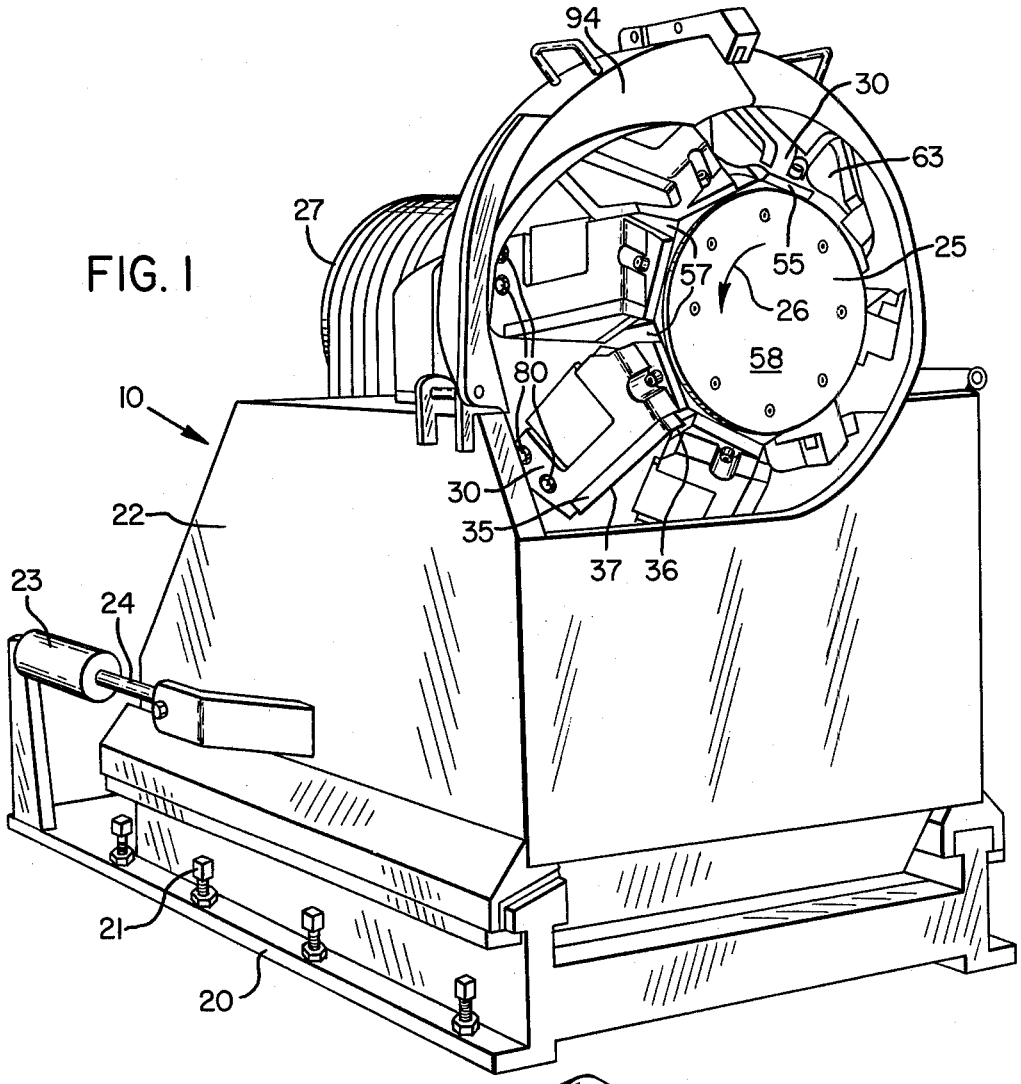
FIG. 1. is a perspective view of a chipper embodying the invention.

Chipper machine 10 in FIG. 1 comprises a base frame 20 rigidly secured to a floor or heavy foundation by bolts 21. The frame 22 of the chipper machine is mounted for sliding movement on base 20 and is adjustable toward and away from the side of a log by hydraulic cylinders 23 and piston rods 24 connected between base 20 and frame 22 on opposite sides of the machine.

Figure 2:
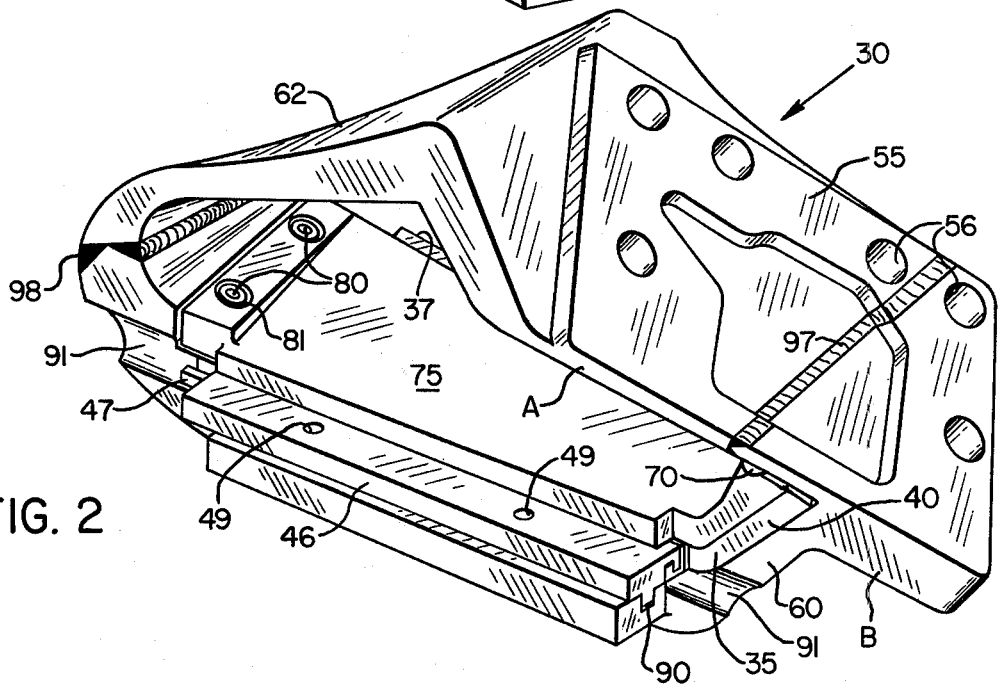
FIG. 2 is a perspective view of a knife holder in FIG. 1.

Mounted on the movable frame 22 is a rotor head 25 rotatable on a horizontal axis and driven in the direction of arrow 26 by driven pulley 27. Pulley 27 is belted to a motor in the casing 22. Mounted on rotor head 25 are a plurality of knife holders 30 which incorporate important features of the present invention. Knife holders 30 carry chipper knives arranged to plane a flat surface on one side of a log as illustrated in FIGS. 1 and 2 in said U.S. Pat. No. 3,777,793.

Figure 9:
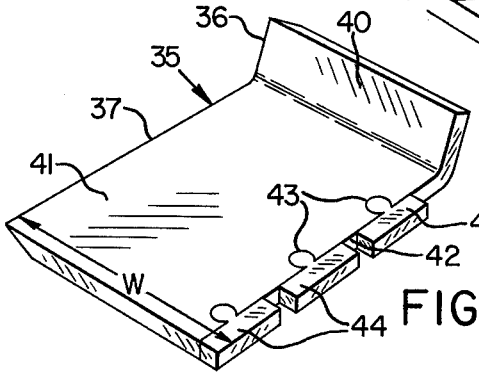
FIG. 9 is a perspective view of a knife.

Each knife holder 30 carries a knife 35. As shown in FIG. 9, the knife 35 comprises a bent blade having a sharpened planing edge portion 36 and a sharpened chip cutting edge portion 37. The planing edge portion 36 planes a smooth, flat surface on the log while the chip cutting edge portion 37 cuts off chips on a conical surface as explained in said patent. Edge portion 37 is considerably longer than edge portion 36 and these two edge portions are disposed at an angle of approximately 125° relative to each other. Edge portion 36 is formed on a flat shank portion 40 and edge portion 37 is formed on a flat shank portion 41.

The rear edge 42 of shank portion 41 is provided with a plurality of keyhole slots 43 which are chamfered on one side. Babbit blocks 44 are cast on back edge 42 and interlocked in the chamfered keyhole slots 43. This provides a constant width W which is maintained throughout the life of the knife.

Each time the cutting edge 36, 37 is sharpened, the babbitt material 44 is removed and the knife is placed in a jig for casting new babbitt blocks 44. After repeated sharpenings the knife becomes narrower and the babbitt material 44 increases in width to maintain the constant dimension W as shown in FIG. 9. This allows the knife to be re-sharpened many times before it is too narrow for further use since there are no deep slots to receive the usual clamp screws.

Figure 7:
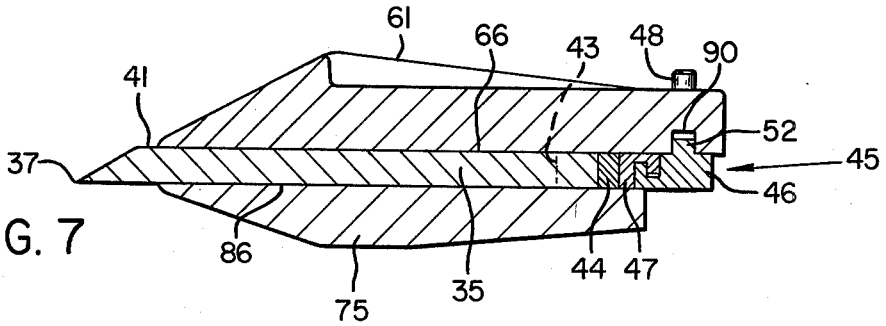
FIG. 7 is a view on the line 7—7 in FIG. 5.
Figure 10:
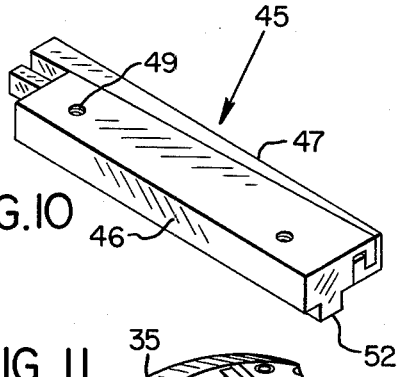
FIG. 10 is a perspective view of a backing bar and wedge assembly for adjustment of the knife.

Referring now to FIGS. 7 and 10, a backing bar assembly 45, comprising a fixed bar 46 and movable bar, or wedge, 47, is attached to knife holder 30 by screws 48 in screw holes 49 through a tongue or flange 52. Screws 48 also serve to clamp movable bar 47 in place after adjusting the knife.

The two parts 46 and 47 are machined with an interlock on a taper, as shown, in such a way that when movable bar 47 is moved longitudinally, the assembly increases in width to provide for knife adjustment. This adjustment is permanent, with additional pressure being exerted on the assembly when the knife is clamped in place, as will presently be explained.

As seen in FIG. 2, each holder 30 has a flat base or mounting pad portion 55 with holes 56 to receive screws for mounting the holder on a flat side 57 of the rotor head 25. The mounting surfaces 57 appear in FIG. 1. In the present illustration the rotor is octagonal with eight side surfaces 57 each lying in a plane parallel with the rotor axis and each carrying one of the knife holders 30. Thus, the eight flat surfaces 57 are all perpendicular to the rotor end surface 58 in FIG. 1.

Referring now to FIG. 5, each knife holder 30 has a short straight leg 60 perpendicular to base 55 and a long straight leg 61 disposed at an angle of approximately 125° to leg 60. The outer end of leg 61 is supported by a curved back leg 62, the parts 55, 60, 61 and 62 forming an integral, rigid member having a chip opening 63 extending therethrough.

Figure 8:
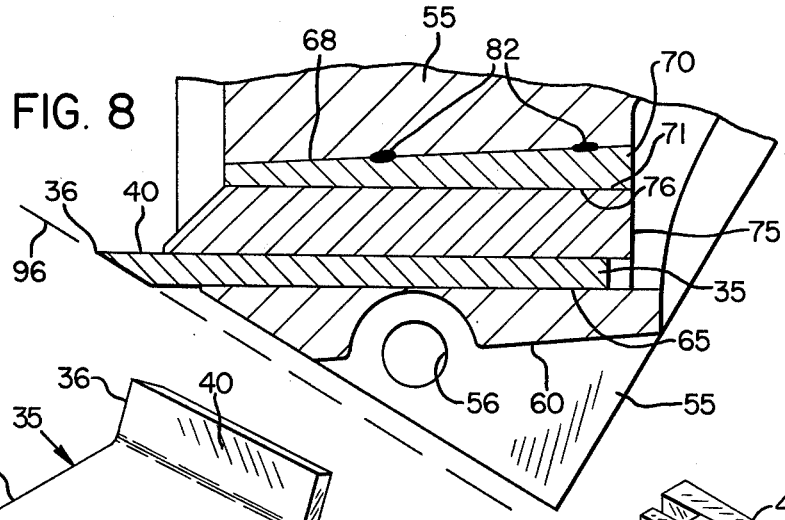
FIG. 8 is a view on the line 8—8 in FIG. 5.

Leg portions 60 and 61 of the holder 30 have flat inside supporting surfaces 65 and 66 to receive and position the back sides of the knife shank portions 40 and 41 as also shown in FIGS. 7 and 8. In FIG. 5, base portion 55 is provided with an abutment surface 68 opposed to the knife supporting surfaces 65 and 66. A wedge 70 having a convex semi-cylindrical bearing surface 71 is seated on abutment 68.

The knife clamp plate 75 in FIG. 3 has a partial concave cylindrical surface 76 on one side to mate with and pivot on cylindrical bearing surface 71 on wedge 70.

Clamp plate 75 is crowned or cambered in a transverse arch as indicated by the small angle 85 in FIG. 3. This causes the convex surface 86 of the clamp plate to bear first against a side portion of knife 35 as indicated by the initial position of the clamp plate at 75*a* in broken lines in FIG. 5.

The opposite side edge portion of clamp plate 75 is provided with bolt holes 77 and nut recesses 78 to receive bolts 80 in holder 30, and nuts 81, as shown in FIGS. 3, 5 and 6. Then the tightening of bolts 80 in nuts 81 pivot the clamp plate on wedge 70 and flatten the clamp plate, which is resilient, removing the camber and causing clamping surface 86 to bear against substantially the entire surface of shank portion 41 of the knife.

At the same time, an angled surface 87 extending along one side of the clamp plate bears against the narrow shank portion 40 of the knife, clamping it firmly against supporting surface 65. The angular knife seat 65, 66 serves as positioning means for the knife. This dual clamping action against shank portions 40 and 41 allows the use of two-piece knives, if desired, whereby the narrow shank portion 40 may be a separate knife.

As is apparent in FIGS. 1 and 5 the heads of bolts 80 are accessible for the use of impact or power wrenches. Before bolt 80 are tightened, the open position of the clamp plate at broken lines 75*a* in FIG. 5 provides clearance for insertion and removal of knife 35. In initial assembly, clamp plate 75 is tightened by bolts 80 with wedge 70 in approximate lengthwise position. Wedge 70 is then driven into final position reducing the camber in clamp plate 75 to zero. Wedge 70 is then tack welded in place as indicated by welds 82 in FIG. 8. Tack welds 82 may be burned away if it should subsequently be necessary to remove or readjust wedge 70.

In the above described clamping operation the projection of the knife from the holder is fixed by the position of wedge bar 47 and flange 52 on backing bar 46 which projects into slot 90 in leg 61 of the holder as shown in FIG. 7. Screws 48 enter tapped holes 49 in fixed backing bar 46 to secure the backing bar assembly 45 in the holder 30 and clamp wedge bar 47 in adjusted position.

The procedure for adjusting a knife involves inserting a knife in the holder and tightening bolts 80 moderately, loosening screws 48 slightly, driving wedge bar 47 in to force the knife outward as necessary, and re-tightening screws 48. If retraction of the knife is required, wedge bar 47 is driven to the opposite side and the knife is repositioned to the wedge before adjusting outward. Grooves 91 in holder 30 provide relief for driving the wedge bar 47 in opposite directions as may be necessary, as shown in FIG. 2.

In operation, the log approaches the machine from the left in FIG. 1 and travels to the right so that the cutting strokes of the knives are in a downward direction. The chips pass through openings 63 in the knife holders and, for the most part, are impelled downward into a chip bin or conveyor in the base of the machine. A hood 94 covers the upper portion of the rotor to prevent the upward discharge of stray chips.

In FIG. 1 the end surface 58 of the rotor comprises a smooth, flat, or slightly crowned, plate to bear against and guide the planed surface of the log as it is carried past the chipper by a log carriage as described in said patent. In FIG. 4 the effective plane of this bearing surface is represented by the broken line 96. By means of the movable backing bar 47 in FIG. 7, the planing edges 36 of the knives are adjusted to cut in a plane a very slight distance in an axial direction from the plane 96 to provide a slight clearance space.

The present clamping arrangement employing pivoting action on a cambered clamp plate is also obviously readily adaptable to a single flat knife.

When knife holder 30 is cast in one piece as taught in said prior patent the interior finishing operations must be done with a shaper, which is a very tedious job. The present holder 30 is therefore made in two pieces so that the finishing operation necessary to position the knife, clamp plate and wedge 70 may be done as a milling operation, which is much faster.

Thus the present holder 30 is cast in two parts A and B which are joined together, after machining, by welds 97 and 98. Part A comprises leg 62 and part of mounting pad 55 while part B comprises leg 60 and 61 and the est of mounting pad 55.

The mating edges of parts A and B may be shaped to provide positioning as well as welding preparation when the castings are made. Drilling and machining of the mounting pad may be done before or after welding, depending upon the exact position of weld line 97.

Figure 12:
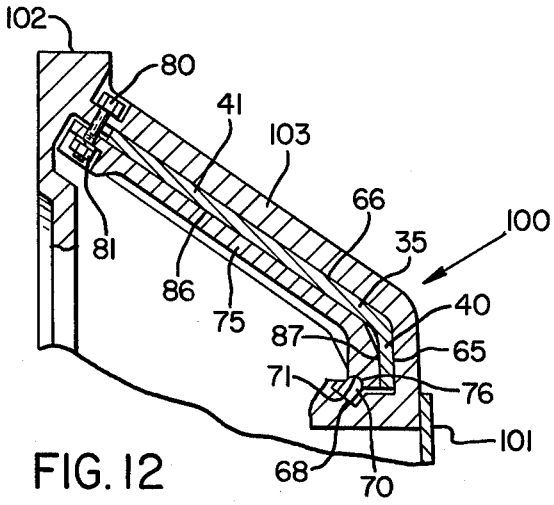
FIG. 12 is a view on the line 12—12 in FIG. 11.
Figure 11:
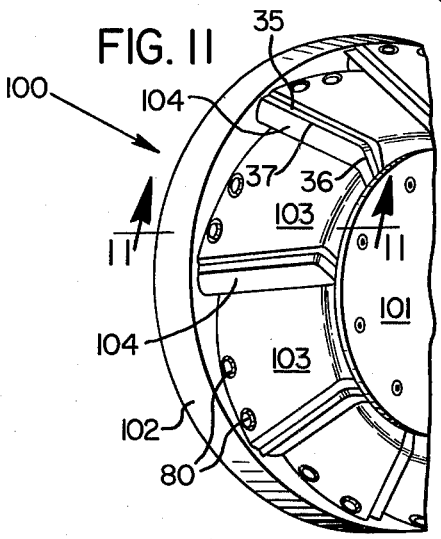
FIG. 11 is a perspective view of a modified rotor head embodying the invention.

FIGS. 11 and 12 show a modification wherein the chipping head or rotor has integral knife holders. The rotor 100 has a smooth log-supporting and guiding end surface 101 corresponding to the end surface 58 in FIG. 1. The back end of the rotor has a cylindrical portion 102.

Extending between the end portions 101 and 102 is a series of flat plate portions 103, each of which recedes radially at its trailing end to provide an opening at 104 for the passage of chips into the inside of the rotor. Knives 35 are the same as shown in FIG. 9, having sharpened planing edges 36 and sharpened chip cutting edges 37. On the inside of each plate portion 103 is a supporting surface 65 for knife shank portion 40 and a supporting surface 66 for knife shank portion 41.

Wedge 70 is supported on abutment surface 68. Cambered, resilient clamp plate 75 has a concave partial cylindrical bearing surfaces 76 along one side edge to pivot on semi cylindrical surface 71 on wedge 70. The clamp plate tightening bolts 80 are accessible outside the rotor to tighten the clamp plates against the knives, as described in the first embodiment. The operation of the machine is the same as described in connection with the first embodiment.

What is claimed is :

1. A holding means for a woodworking knife comprising a support member having a surface arranged to support one face of the knife, a resilient cambered clamp plate having a convex face confronting the opposite face of said knife, a wedge in said support member confronting the opposite face of said clamp plate along one side of the clamp plate, said opposite face of the clamp plate having a partial cylindrical bearing surface pivoting on a mating partial cylindrical bearing surface on said wedge, screw means in said support member at the opposite side of the clamp plate arranged to pivot the clamp plate on said wedge and flatten the clamp plate against said knife to clamp the knife against said supporting surface, and means to hold the knife in adjusted position on said supporting surface.

2. A holding means as defined in claim 1, said bearing surface on said clamp plate being concave and said bearing surface on said wedge being convex.

3. A holding means as defined in claim 1 including a wedge abutment surface on said support member opposed to said knife supporting surface to slidably receive and seat said wedge.

4. A holding means as defined in claim 3 including a tack weld securing said wedge to said support member.

5. A holding means as defined in claim 1, said means to hold the knife in adjusted position comprising a fixed bar secured to said support member and a wedge bar slidable between said fixed bar and the back edge of the knife.

6. A holding means as defined in claim 5, said wedge bar having an interlocking sliding fit with said fixed bar, and means to clamp said wedge bar in adjusted position.

7. A holding means as defined in claim 1, said support member comprising a flat base portion forming a mounting pad, a short leg portion upstanding from one portion of said base portion, a longer leg portion upstanding from another portion of said base portion, and a third leg portion interconnecting the upper ends of said first two leg portions to provide a chip opening between said base and leg portions, said knife supporting surface being disposed on said short leg and third leg portions; and support member being made in two parts, one of said parts comprising said longer leg portion and a portion of said base portion and the other part comprising the remainder of said base portion, said short leg portion and said third leg portion; said two parts being joined together by a first weld in said base portion and a second weld at the upper end of said longer leg portion.

8. A holding means as defined in claim 7, said wedge and screw means being disposed in said other part of said support member.

9. A holding means as defined in claim 7, said means to hold the knife in adjusted position being disposed in said other part of said support member.

* * * * *

UNITED STATES PATENT AND TRADEMARK OFFICE

CERTIFICATE OF CORRECTION

PATENT NO. : 4,082,127

DATED : April 4, 1978

INVENTOR(S) : Frederick L.B. Miller

It is certified that error appears in the above-identified patent and that said Letters Patent are hereby corrected as shown below:

Column 3, line 63 "bolt" should read --bolts--.
Column 4, line 54 "leg" should read --legs--.
Column 4, line 54 "est" should read --rest--.
Column 6, line 23 " and" should read --said--.

Signed and Sealed this

*Twenty-fifth* Day of *July 1978*

[SEAL]

*Attest:*

RUTH C. MASON
*Attesting Officer*

DONALD W. BANNER
*Commissioner of Patents and Trademarks*